US007086204B2

(12) United States Patent
Sälzer

(10) Patent No.: US 7,086,204 B2
(45) Date of Patent: Aug. 8, 2006

(54) WINDOW OR DOOR WITH PROTECTION AGAINST EXPLOSIVE EFFECTS

(75) Inventor: Heinrich Sälzer, Marburg (DE)

(73) Assignee: Sälzer Sicherheitstechnik GmbH, Marburg (DE)

( * ) Notice: Subject to any disclaimer, the term of this patent is extended or adjusted under 35 U.S.C. 154(b) by 0 days.

(21) Appl. No.: 10/428,798

(22) Filed: May 2, 2003

(65) Prior Publication Data

US 2003/0209332 A1 Nov. 13, 2003

(30) Foreign Application Priority Data

May 8, 2002 (DE) ..... 102 20 833

(51) Int. Cl.
*E04H 9/00* (2006.01)

(52) U.S. Cl. ..... 52/208; 52/217; 52/209; 52/204.5

(58) Field of Classification Search ..... 52/208, 52/204.5, 204.72, 204.71, 204.55, 213, 656.5, 52/209, 214, 1, 217; 109/13, 49.5
See application file for complete search history.

(56) References Cited

U.S. PATENT DOCUMENTS 1,836,980 A * 12/1931 Marty ..... 52/771
2,174,441 A * 9/1939 Gustafsson ..... 52/209
3,858,375 A * 1/1975 Silvernail ..... 52/235
4,525,961 A * 7/1985 Hansen ..... 52/208
5,636,484 A * 6/1997 DeBlock ..... 52/204.5

FOREIGN PATENT DOCUMENTS

DE 35 45 173 A1 6/1987
DE 37 05 401 C2 9/1988

* cited by examiner

*Primary Examiner*—Carl D. Friedman
*Assistant Examiner*—Basil Katcheves
(74) *Attorney, Agent, or Firm*—Boyle Fredrickson Newholm Stein & Gratz S.C.

(57) ABSTRACT

A closure (10) for a building which is inhibitive to explosive effects and with which an opening in a building can be closed off comprises a filling (3) as well as frame elements (1, 2) which enclose the same substantially in a circular fashion. Said frame elements (1, 2) are connected in a non-positive way by means of fastening elements with parts (6) of the building which are adjacent to the opening. In order to achieve a secure connection which withstands high loads between the closure (10) and the part (6) of the building made of building materials of low strength, it is proposed rectangular brackets (4) are fastened to the frame elements (1) on at least two opposite sides of the closure (10). At least one tensile leg (7) each of the brackets (4) extends close to the reveal (L) of the opening. At least one supporting leg (8) each of the brackets (4) extends at a distance from the visible side (9) of the part (6) of the building adjacent to the opening.

20 Claims, 7 Drawing Sheets

Fig. 7
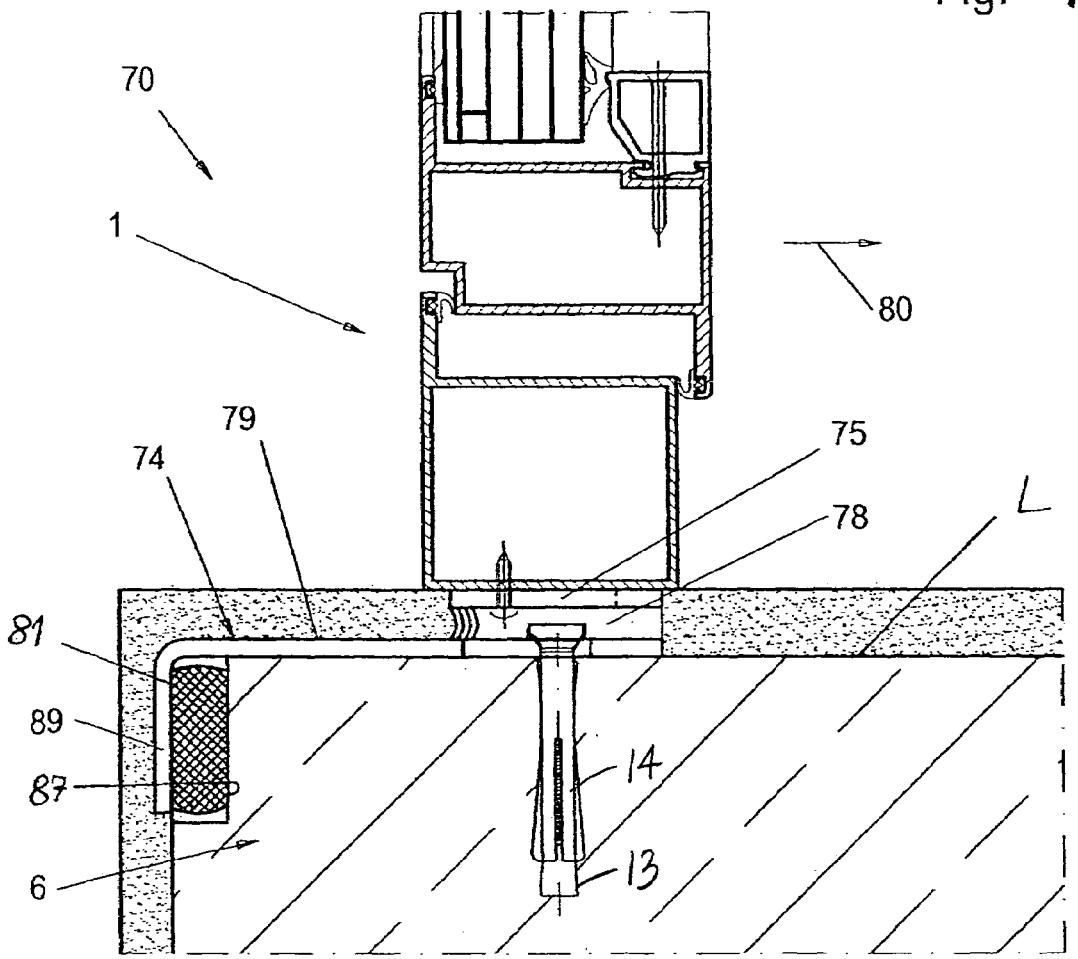
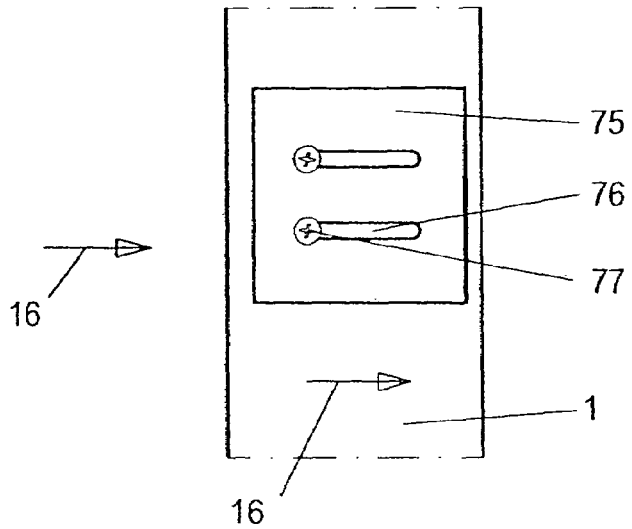
Fig. 8

WINDOW OR DOOR WITH PROTECTION AGAINST EXPLOSIVE EFFECTS

BACKGROUND OF THE INVENTION

1. Field of the Invention

The invention relates to the closure of a building which is designed in a manner so as to be inhibitive to an explosive effect, with the closure being used to seal off a building and comprising a filling and frame elements substantially circularly enclosing the same, with said frame elements being connectable in a non-positive manner by means of fastening elements with parts of the building adjacent to the opening.

Closures of a building within the terms of the present invention shall especially be understood as being doors or windows. The latter can be provided with rigid as well as rotatable and/or tiltable designs. Principally, it is also possible to consider all other planar elements such as facade elements or the like, irrespective of whether they are designed of metal and/or plastic and/or glass and/or wood, with which the opening of a building can be closed off. The term frame elements shall be defined within the terms of the present invention in such a way that this shall include the legs of door frames or, in the case of rotatable and/or tiltable windows, casements of windows. Said frames can consist of profiles made of plastic and/or metal, especially aluminum as well as steel, or also of wood. Closures of buildings which are inhibitive to explosive effects are especially characterized in that they withstand blast waves as occur especially in the case of detonations outside of buildings without leading to any breakages of the filling or without the closure of the building being torn in its entirety, including its frame elements, out of the parts of the building adjacent to the opening with which the closure of the building is joined in a non-positive manner.

2. Description of the Related Art

In generally known closures of buildings which are designed in a manner so as to be inhibitive to explosive effects as are described in DE 37 05 401 C2, screws and dowels are used in particular as fastening elements which are introduced into bores in the jamb or reveal. The dowels can either consist of metal and the screws can have a machine tap. It is also widely customary to use plastic dowels as an alternative thereto which usually cooperate with screws with a thread for woodwork.

It has proven to be disadvantageous in connection with the aforementioned connection elements in that they are not suitable for a secure anchoring of closures of buildings in cases where the parts of buildings into which the pertinent bores are introduced do not have the required strength. This can be the case in old buildings with brittle stone materials or even sandy or at least insufficiently strong casts in the region of the reveal. Difficulties in connection with the said fastening elements also occur when, as is frequently the case in new buildings, perforated bricks are used in which the air chambers form a relevant part of the stone material. In the case of higher pressure loads, the conventional fastening of the closures can lead to the consequence that they are pulled completely out of their anchoring.

A window arrangement which is inhibitive to the effects of explosive effects is further known from DE 35 45 173 A1 which comprises a special embodiment for combination with a roller shutter. The window frame is anchored on the outside surface of the wall of the building comprising the window opening and not in the reveal of the same. Said anchoring occurs with the help of a profile which is Z-shaped in its cross section and circularly encloses the window frame. The laminated safety glass forming the filling rests on a permanently deformable hollow body in the form of a plastic tube body which has a rectangular cross section and which is permanently deformed in the case of a blast wave occurring during an explosion by force exerted on the laminated safety glass. While the Z-shaped holding profile rests directly on said outside surface with its leg which is situated on the outside surface of the window opening and is fixed there by means of anchors, a relative movement occurs between the laminated safety glass and the Z-like profile. Moreover, an opening of the known windows is not possible due to the direct damping connection between the laminated safety glass and the Z-like profile.

BRIEF SUMMARY OF THE INVENTION

The invention is thus based on the object of providing a closure for a building which is inhibitive to explosive effects and can be securely anchored even in the case of materials of adjoining parts of the building which have an only insufficient strength.

Based on a closure for a building of the kind mentioned above, this object is achieved in accordance with the invention in such a way that rectangular brackets are fastened to the frame elements on at least two opposite sides of the closure, with at least one tensile leg each of the brackets extending in the vicinity of the reveal of the opening and at least one supporting leg each of the brackets resting on the visible side of the building part adjacent to the opening.

In the closure in accordance with the invention the support of the forces which act in one direction perpendicular to the plane defined by the filling occurs with the help of brackets whose supporting legs can be dimensioned to such a large extent with respect to their surface area extending parallel to the visible side of the building part adjacent to the opening that the surface pressing can be reduced to such an extent that even brickwork material of lower strength is not damaged even in the case of a high pressure load on the window. In addition to the surface area supported by the supporting leg, there is a further possibility for influencing the surface pressing caused in the case of a stress in that the number of the brackets used in total per closure is varied. As a result, there is a possibility on the one hand to attach the brackets merely on two opposite sides of the closure in the case of lower demands made on stability. In the case of highest demands placed on the inhibition against the blasting effects however, the brackets can be attached to all (four) sides. A further advantage of the closure is that the introduction of the force into the parts of the building enclosing the opening occurs on the pressure-loaded side (when regarding the positive blast wave) and therefore the entire wall thickness acts in a supporting manner. On the other hand, there is a likelihood in the case of fastening the closure by means of anchor-like fastening elements which are attached in the middle of the reveal that, especially in the case of lower wall thicknesses in combination with a respectively low strength of the material, the wall parts which are arranged in the loading direction behind the fastening elements will be broken out in larger parts in the direction towards the interior of the room. In the solution in accordance with the invention, wall parts with a thickness of the entire wall would have to be pressed out, which is virtually excluded in view of the reduced surface pressing anyway and the thus avoid the notch or wedge effect.

The relevant feature of the invention is the fact that in the initial state of the mounted window there is a distance between the supporting legs of the brackets and the associated visible surface of the wall of the building. A force is introduced into the ambient part of the building only after this distance has been reduced. Since the reduction of the distance between the supporting leg and the visible side of the part of the building occurs under the dissipation of energy, the load on the part of the building is considerably reduced as compared with the case where a Z-like holding profile rests in a rigid manner for example and without any distance and damping on the visible surface of the building. If a clearance is situated in the installed state between the supporting surfaces of the brackets and the visible side of the part of the building, a dissipation of energy must be provided in the region of the reveal where a connection between the tensile leg and the brickwork must be given. Alternatively it is also possible to fill the intermediate space between the supporting leg and the visible side of the part of the building with a damping material which dissipates energy during its compression. The filling can occur in part or in full.

As a result, the peak load is considerably reduced in any case during the initiation of the force into the ambient brickwork which does not occur at the beginning of the blast wave.

According to an embodiment of the subject matter of the invention it is provided that between the supporting leg and the associated abutment surface of the visible part of the part of the building, a damping element is arranged and that further anchor-like fastening elements are present in the region of the tensile leg of the closure of the building which allow a movement of the closure in a direction which is perpendicular to a plane which is defined by the filling.

As a result of this measure, the force to be absorbed by the building parts enclosing the opening is reduced even further because a part of the energy is dissipated beforehand by the interposed damping elements. The higher the displacement of the closure in the direction of the force which occurs during the introduction of the force and the higher the force occurring thereby, the higher the energy absorbed during this process and the lower the force peak that may occur at the end of the displacement path and be absorbed by the building parts.

An especially advantageous further development is in this connection that the fastening elements are conventional anchors, e.g. screws arranged in dowels, which penetrate the tensile legs in oblong holes extending parallel to the direction of the possible displacement. It is also prevented in this manner that the brackets can escape in a direction parallel to the plane defined by the filling.

Possible damping elements can be plastically deformable strips of sheet metal which can be provided with a trough-like or roof-like arrangement or can be deformable plastic materials with gas pockets such as cellular rubber or neoprene.

In order to also ensure a secure support of the reflection forces acting in a direction opposite of the main loading direction which occur after the blast wave was reflected on the closure, it is appropriate to provide the brackets with a U-shaped arrangement. If such U-shaped brackets consist of two L-shaped parts which are mutually joined by means of screwed connections or welding, simple mounting is ensured even in the case of a subsequent installation of the closure in accordance with the invention.

A simple possibility for joining the closure with the brackets is that they are screwed together with a frame element. The screwed connection is especially advantageous because in this case different materials in the frame element (e.g. aluminum) and the brackets (e.g. steel) can be combined with each other.

BRIEF DESCRIPTION OF THE DRAWINGS

The invention is now explained in closer detail by reference to several embodiments of a closure of a building shown in the drawings, wherein:

FIG. 7 shows an arrangement as in FIG. 2, but with a possibility for displacement between the bracket and the associated frame element, and FIG. 8 shows a side view of the window frame of the closure according to FIG. 7.

DETAILED DESCRIPTION

Figure 1:
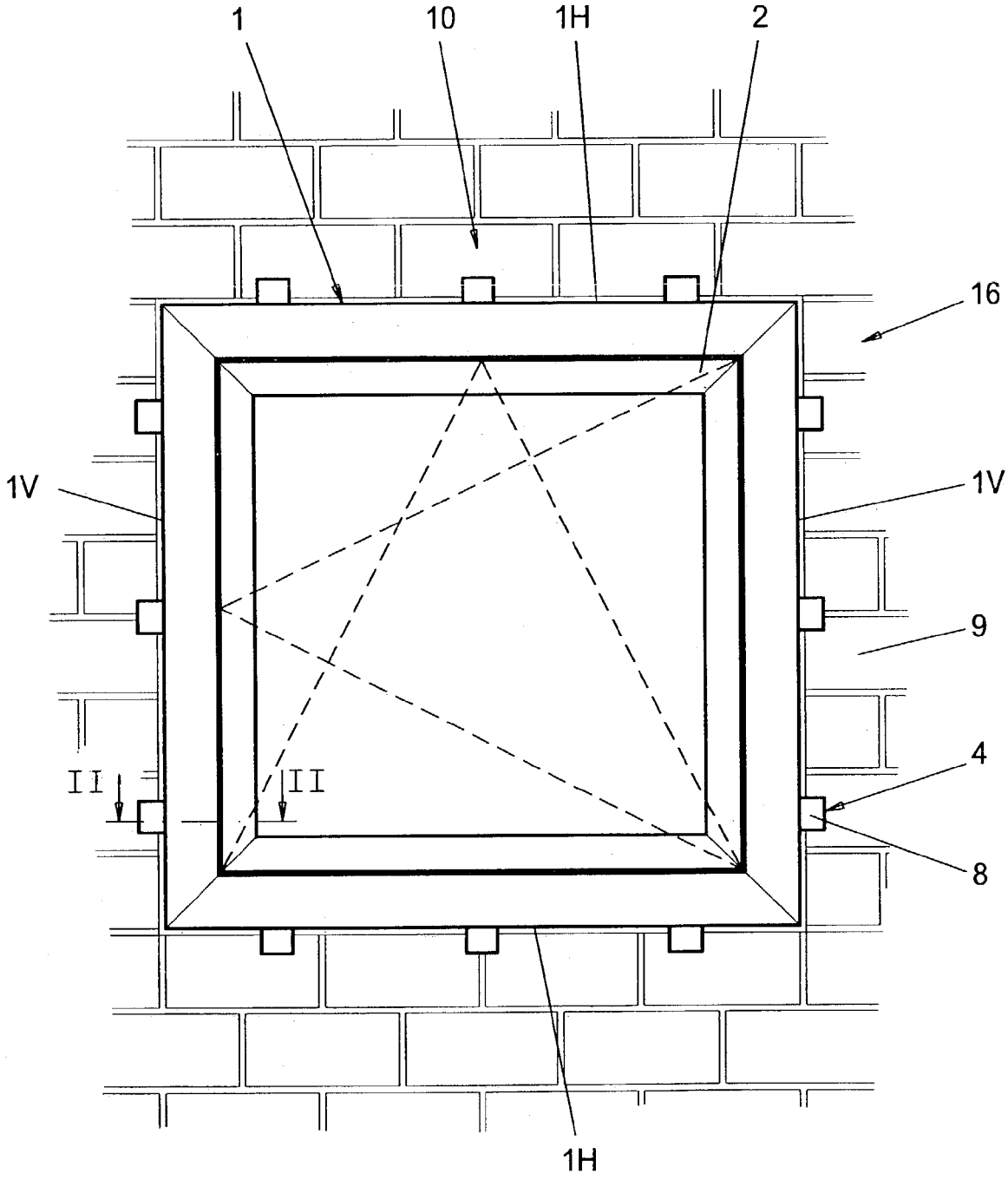
FIG. 1 shows an outside view of a closure of a building arranged in the form of an outswinging and bottom-hinged sash window with brackets on all four sides of the window frame.
Figure 2:
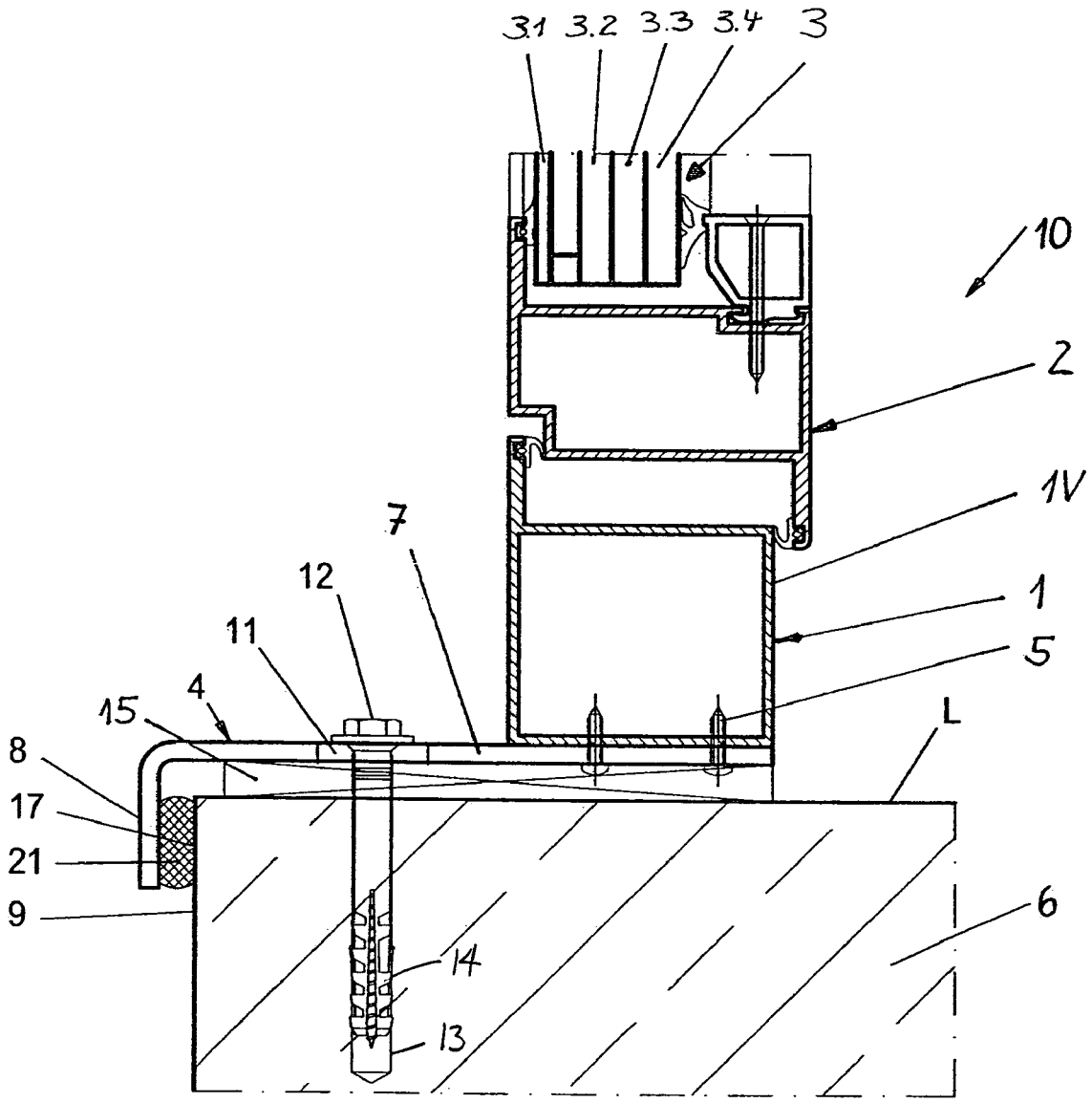
FIG. 2 shows a cross-sectional view along the line II—II through the window frame and the casement of the closure according to FIG. 1.

A closure 10 of a building as shown in FIGS. 1 and 2 consists of a window frame 1 which is composed of two horizontal frame legs 1H and two vertical frame legs 1V as well as a casement 2 which is held therein in a pivoting and tilting fashion and which is composed in the known manner of two opposite horizontal and vertical frame legs each. The casement 2 comprises a filling 3 which consists of four glass panes 3.1, 3.2, 3.3 and 3.4 which extend parallel with respect to each other.

All four legs 1V and 1H of the window frame 1 are each provided with three brackets 4 which are screwed together by means of two sheet metal screws 5 with the window frame 1 which is arranged as a hollow profile. Every bracket 4 consists of a tensile leg 7 extending parallel to the reveal L of a building part 6 and a supporting leg 8 which is arranged rectangularly with respect to the same and extends at a distance parallel to a visible side 9 of the building part 6. Furthermore, the tensile leg 7 of each bracket 4 is provided with an oblong hole 11 through which a screw 12 is guided which is anchored in a dowel 14 introduced into a bore 13. For compensating dimensional tolerances and for the purpose of facilitating mounting, the tensile leg 7 of bracket 4 rests on reveal L via a stand 15 made of hardwood or plastic.

If an explosion occurs on the outside of the building, the blast forces act in the direction of arrow 16 upon the closure 10 and try displacing the same in the same direction. The forces which are forwarded via the generally known locking elements when the casement 2 is closed are transmitted in the form of tensile forces into the tensile leg 7 of the brackets 4 in order to be introduced in the form of pressure forces in the contact region between the supporting leg 8 of bracket 4 and the associated abutment surface 17 of the visible side 9 of the building part 6. As a result of the large number of brackets 4 and the sufficiently large dimensioned contact surface of the supporting legs 8, surface pressing in the region of the abutment surfaces 17 is so low that even in the case of a material of the building part 6 which shows only low strength values a sufficiently secure and destruction-free introduction of the force is possible. If a slight bending of the projecting section of the supporting leg 8 occurs as a result of the distance between the tensile leg 7 and the reveal L of the building part 6 as produced by the stand 15, this deformation which dissipates the energy and reduces the peak load is enabled by the oblong holes 11 in the tensile legs 7 of the brackets 4.

In the region of the abutment surface between the visible side 9 of the building part 6 and the supporting leg 8 of the bracket 4, a damping element 21 made of an elastic porous plastic material such as cellular rubber or neoprene is arranged. The displacement of the closure 10 in the direction towards the interior of the building which occurs in the load case is enabled by the oblong holes 11 in the brackets 4. As a result of the energy dissipated during the deformation of the damping elements 21, the maximum force introduced into the building part 6 is reduced. No transversal forces are introduced into the screws 12 (apart from frictional forces), so that attacks of forces at certain points with high surface pressings which would pose serious problems especially to brickwork of low strength can be avoided. The screws 12 are essentially used to prevent any yielding of the brackets 4 perpendicular to the reveal L in the case of loading. As an alternative to using the damping elements 21 it is also possible to leave a clearance between the supporting legs 8 and the visible side 9 of the building part 6. Energy absorption occurs up to the time at which the supporting legs 8 come into contact, and only in the region of the screws 12 and the oblong holes 11 in the region of the reveal L.

In the description below of FIGS. 3 to 8, the components which with respect to the previously discussed FIGS. 1 and 2 are identical and are provided with corresponding reference numerals.

Figure 3:
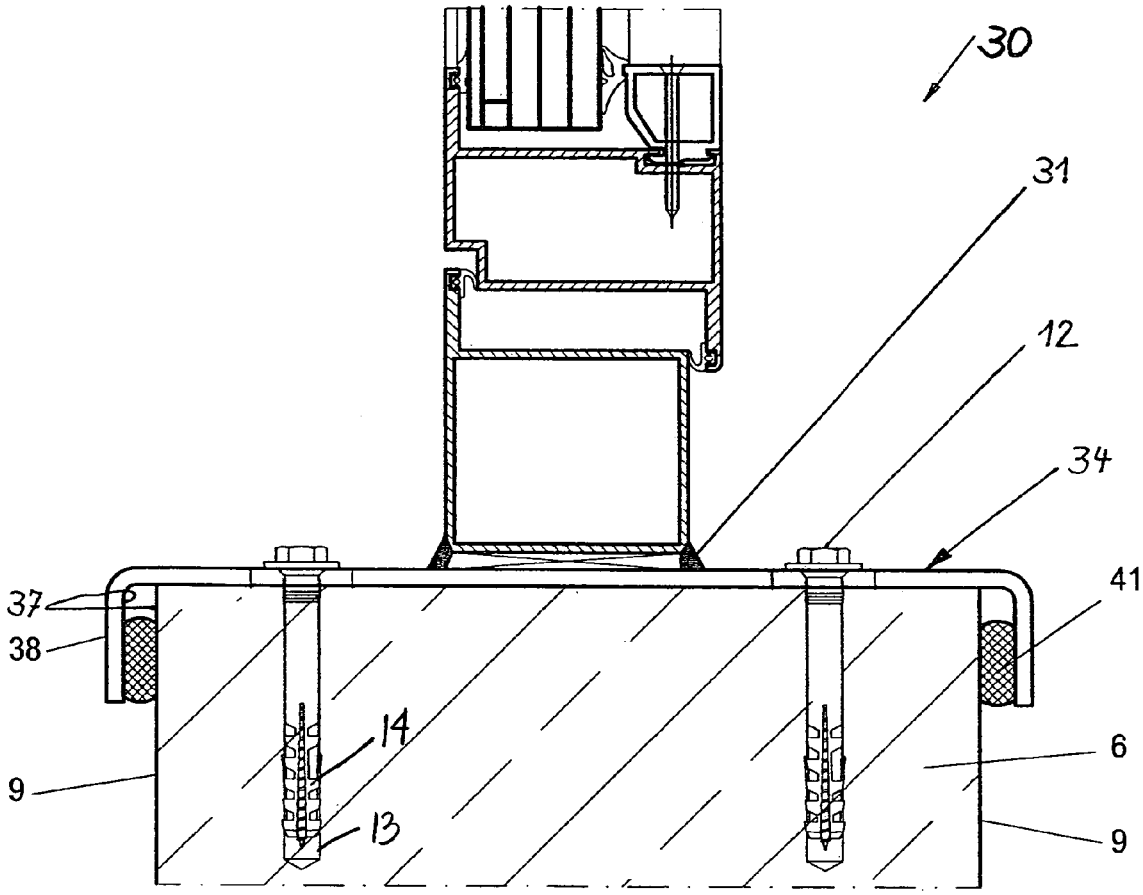
FIG. 3 shows a representation as in FIG. 2, but with U-shaped brackets.

FIG. 3 shows a further closure 30 in which the brackets 34 are U-shaped and are provided on both visible sides 9 of the building part 6 with one supporting leg 38 each which rest on the corresponding abutment surfaces 37 via damping elements 41 arranged on either side. During mounting, the U-shaped brackets 34 are mounted in a first step without the actual window, namely with the help of merely one screw 12 which can be arranged on the inside or outside of the closure 30. In a next step the window is inserted and connected with the brackets 34 with the help of welding spots or seams 31. Then the bracket 34 can be connected by means of the respective second screw 12 on the other side. The damping elements 41 produce a minimization of the maximum forces introduced into the building part 6 both in the case of a positive blast wave as well as the load caused subsequently by its reflection.

Figure 4:
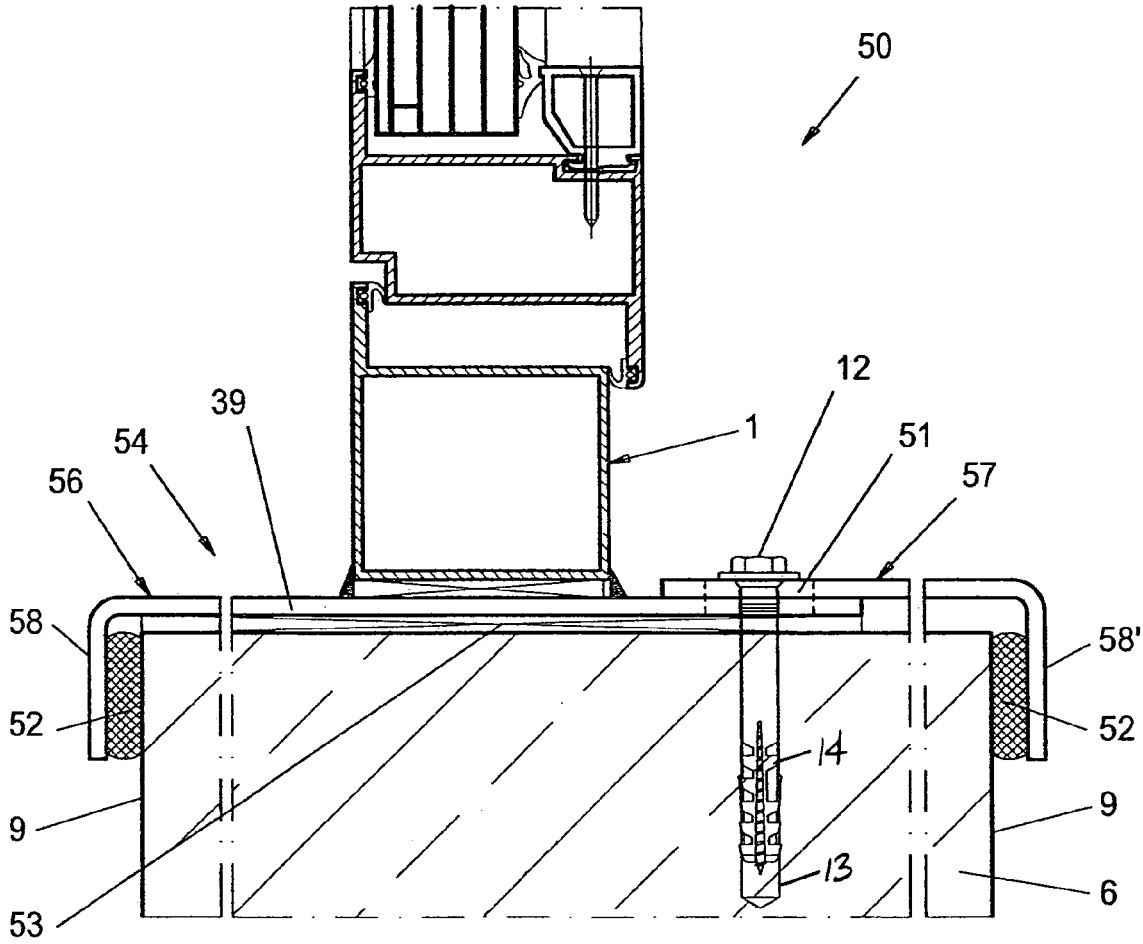
FIG. 4 shows a representation as in FIG. 3, but with U-shaped brackets which are composed of two L-shaped brackets.

In order to avoid the production of the weld connection between the window frame 1 and the bracket 54 at the construction site without having to omit the arrangement of supporting legs 58, 58' on the two opposite visible sides 9, the brackets 54 of the closure shown in FIG. 4 are provided with a two-part configuration and consist of an outside bracket 56 and an inside bracket 57 which are anchored in the building part 6 with the help of a common screw 12 in the region of corresponding oblong holes 51. A stand 53 for compensating dimensional tolerances is placed below the tensile leg 59 of the outside bracket. Damping elements 52 made of an elastically porous plastic material are each situated between the supporting legs 58, 58' and the associated abutment surfaces on the building part 6.

Figure 5:
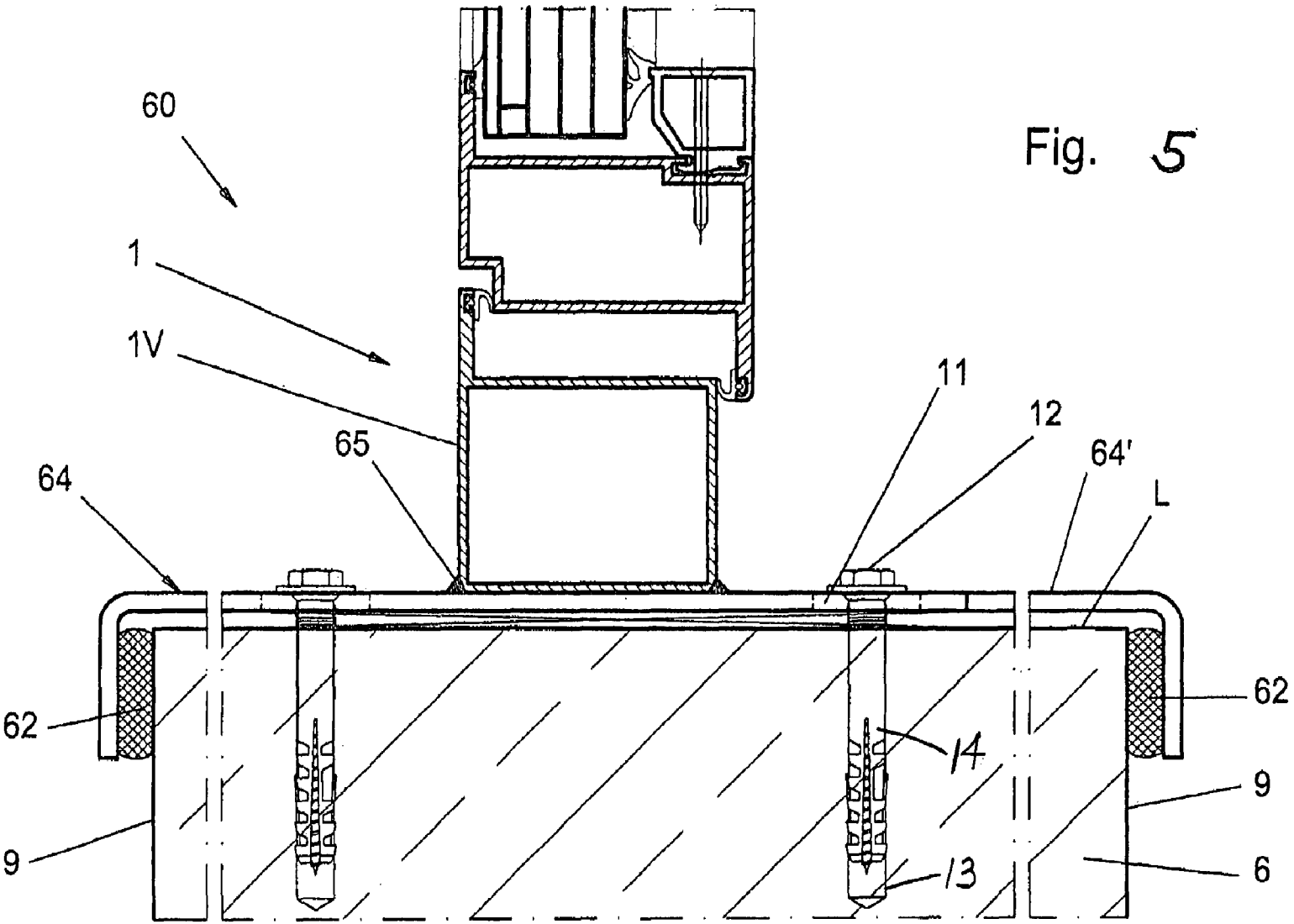
FIG. 5 shows a representation as in FIG. 4, but with L-shaped brackets which are arranged in an offset fashion in the perpendicular direction and are aligned oppositely.
Figure 6:
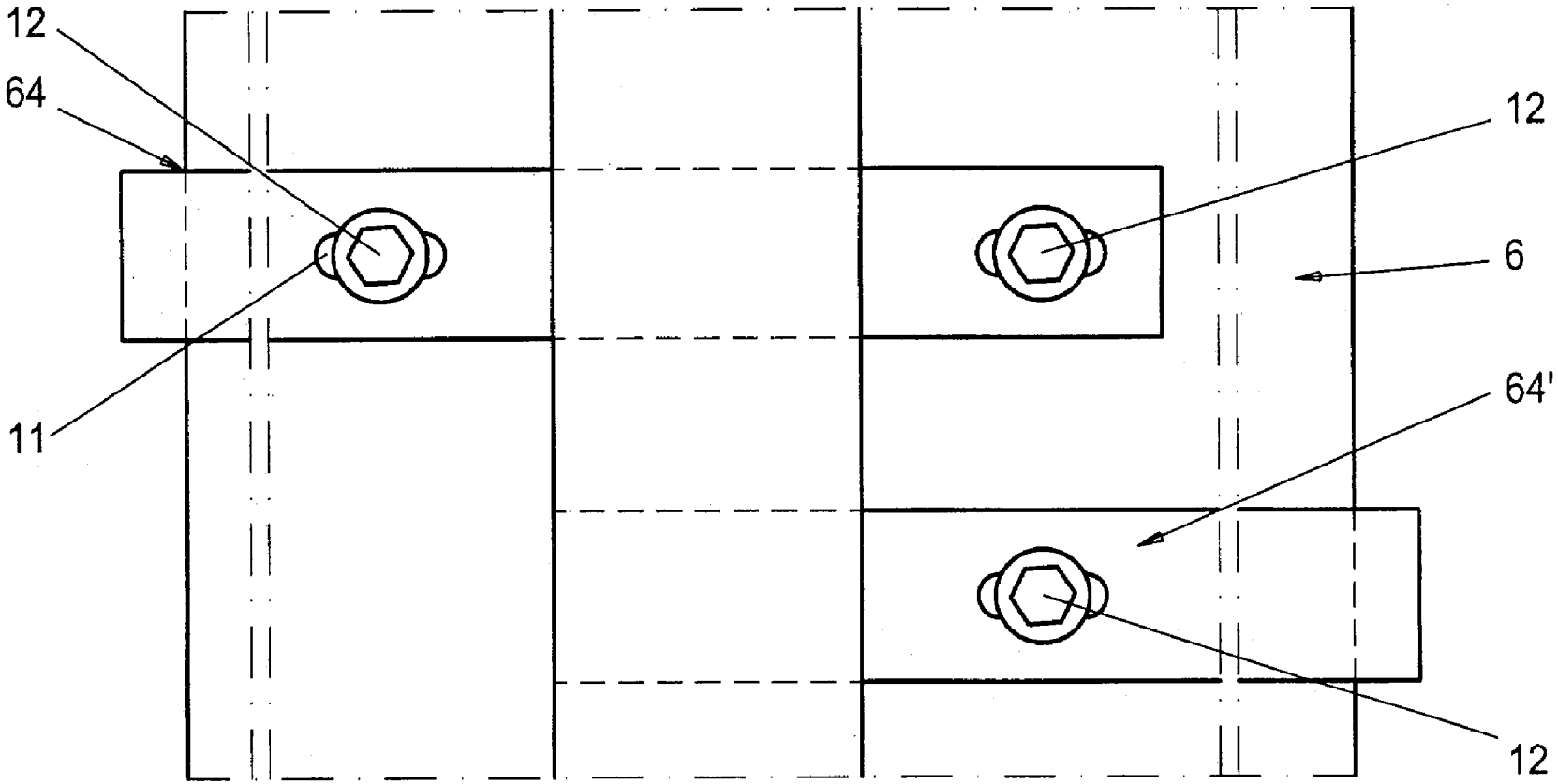
FIG. 6 shows a front view of the brackets according to FIG. 5.

FIGS. 5 and 6 show a closure of a building 60 in which outside brackets 64 and inside brackets 64' are arranged alternatingly in the direction of the legs 1V and 1H of the window frame. While both brackets 64 and 64' are joined to the window frame 1 by means of welding seams or welding points 65, the outside brackets 64 are joined to the building part 6 by means of two screws 12. In the case of the inside brackets 64' this is the case with only one screw 12, however. Whereas either the outside brackets 64 or the inside brackets 64' can be joined to the window frame 1 already prior to the mounting of the closure 60 (by welding as also by screwing), the respective other brackets 64, 64' are inserted only after the insertion of the closure 60 into the opening of the building to be closed off in the remaining gap between window frame 1 and reveal L and joined with the window frame (preferably by welding) and then screwed together with the building part 6. Both types of brackets 64, 64' are again provided with oblong holes 11 for the screws 12 and rest by means of damping elements 62 on the respective visible side 9 of the building part 6.

Finally, FIGS. 7 and 8 shows a further variant of a closure 70 in which the connection between the window frame 1 and a merely L-shaped bracket 74 occurs by means of a coupling plate 75 which is connected wit the bracket 74. It comprises two oblong holes 76 in which screws 77 are displaceably received. The screws are screwed into respective bores in the window frame 1. The coupling plate 75 is coupled by means of welding via a connection piece 78 with the tensile leg 79 of bracket 74 in such a way that a clearance for the sliding movement in the oblong holes 76 remains above the connection piece 78. In the case of a blast effect in the direction of arrows 16 as produced by an explosion (starting out from the initial situation as shown in FIGS. 7 and 8), a displacement of the window frame 1 (i.e. the entire closure 70) is possible in the direction of arrow 80. In the case of this forced friction-involving displacement which occurs in all brackets 74 circularly distributed about the window frame, a part of the pressure energy acting upon the closure 70 is absorbed, so that force occurring at the end of the displacement path and introduced via the supporting legs 89 of the brackets 74 into the building part 6 is clearly reduced. A relative movement between the brackets 74 and the reveal L is possible, with an elastoplastic damping element 81 being arranged between the supporting legs 89 and the opposite abutment surface 87.

The invention claimed is:

1. A closure for a building designed so as to be inhibitive to an explosive effect, with which an opening in a building can be closed off, comprising: a filling as well as frame elements substantially enclosing the same in a circular fashion, with the frame elements being connected by means of fastening elements to parts of the building which are adjacent to the opening, characterized in that rectangular brackets are fastened to the frame elements on at least two opposite sides of the closure, with at least one tensile leg of each of the brackets extending close to the reveal of the opening and at least one supporting leg of the brackets, which extends in a substantially rectangular manner thereto, extending at a distance from a visible side of the part of the building adjacent to the opening, wherein the fastening elements penetrate the building in a direction generally parallel to the plane of the opening, characterized in that a damping element is arranged between the supporting leg and an associated abutment surface of the visible side of the part of the building, and that further anchor-like fastening elements are arranged in the region of the at least one tensile leg and allow a displacement of the closure in a direction perpendicular to a plane defined by the filling, characterized in that the fastening elements are anchors which penetrate the tensile leg in oblong holes which extend parallel to a direction of the displacement.

2. A closure for a building as claimed in claim 1, characterized in that the damping element is a plastically deformable strip of sheet metal.

3. A closure for a building as claimed in claim 2, wherein the rectangular brackets each include L-shaped parts which are which are mutually joined by means of screwing or welding to form a U-shape.

4. A closure for a building as claimed in claim 3, wherein the frame elements of the closure are screwed together with the associated rectangular brackets.

5. A closure for a building as claimed in claim 2, wherein the frame elements of the closure are screwed together with the associated rectangular brackets.

6. A closure for a building as claimed in claim 1, characterized in that the damping element consists of an elastically deformable plastic material with gas pockets.

7. A closure for a building as claimed in claim 6, wherein the rectangular brackets each include L-shaped parts connected by means of screwing or welding.

8. A closure for a building as claimed in claim 6, wherein the frame elements of the closure are screwed together with the associated rectangular brackets.

9. A closure for a building as claimed in claim 1, wherein the rectangular brackets are mutually joined along their tensile legs by means of screwing or welding to form a U-shape.

10. A closure for a building as claimed in claim 9, wherein the frame elements of the closure are connected with the associated rectangular brackets.

11. A closure for a building as claimed in claim 1, characterized in that a frame element of the closure is screwed together with the associated rectangular brackets.

12. A closure for a building as claimed in claim 11, characterized in that the damping element is a plastically deformable strip of sheet metal.

13. A closure for a building as claimed in claim 11, characterized in that the damping element consists of an elastically deformable plastic material with gas pockets.

14. A closure for an opening in a building having a visible side, comprising:

a transparent covering for the opening;

at least two frame elements enclosing the covering in a substantially circular fashion, wherein the frame elements are connected in a force transmitting manner;

at least two pairs of rectangular brackets fastened to the frame elements on at least two opposite sides of the covering, wherein at least one tensile leg of the brackets is spaced from a reveal of the opening, and wherein at least one supporting leg of the brackets extends at a distance from the visible side of the building adjacent to the opening; and at least one dampening element located between the supporting leg and the visible side of the building, wherein at least one of the brackets is attached at the frame by at least one fastening means along the tensile leg of at least one of the brackets, and wherein each bracket is secured to the building by a fastener and a dowel arrangement wherein the fastener passes through an oblong hole in the tensile leg of each bracket and penetrate the building so that the frame elements are indirectly connected to the building.

15. The closure of claim 14, further comprising:

at least one bracket having a two-part configuration of an outside bracket portion and an inside bracket portion;

a stand between at least the tensile leg of the outside bracket and the building; and a coupling plate having at least one oblong hole that is connected to the at least one bracket and one frame element.

16. A closure for a building designed so as to be inhibitive to an explosive effect, with which an opening in a building can be closed off, comprising:

a filling; and frame elements substantially enclosing the filling in a circular fashion, the frame elements connected by fastening elements to the building adjacent to the opening, wherein rectangular brackets are fastened to the frame elements on at least opposite sides of the closure, wherein a tensile leg of the rectangular brackets extends close to the reveal of the opening, wherein a supporting leg of the rectangular brackets, the supporting leg extending in a substantially perpendicular manner relative to the tensile leg, extends at a distance from a visible side of the building adjacent to the opening, wherein the fastening elements penetrate the building in a direction generally parallel to the plane of the opening, wherein a damping element is arranged between the supporting leg and an associated abutment surface of the visible side of the building, wherein anchor-like fastening elements are arranged in a region of the tensile leg and allow a displacement of the closure in a direction perpendicular to a plane defined by the filling, and wherein the fastening elements penetrate through oblong holes in the tensile leg, the oblong holes extending parallel to a direction of the displacement of the closure.

17. The closure as recited in claim 16, wherein the damping element is a plastically deformable strip of sheet metal.

18. The closure as recited in claim 16, wherein the damping element consists of an elastically deformable plastic material with gas pockets.

19. The closure as recited in claim 16, wherein each of the tensile legs of the rectangular brackets is mutually connected by one of a means of screwing and a means of welding to form a U-shape.

20. The closure as recited in claim 16, wherein the frame element of the closure is screwed together with the rectangular brackets.

* * * * *